United States Patent [19]

McDonald

[11] 4,290,607

[45] Sep. 22, 1981

[54] TRAVEL GAME DEVICE

[76] Inventor: Gerald F. McDonald, 169 Reveillon St., Apt. 10, Sept Iles, Quebec, G4R 3R3, Canada

[21] Appl. No.: 39,872

[22] Filed: May 17, 1979

Related U.S. Application Data

[63] Continuation-in-part of Ser. No. 692,365, Jun. 3, 1976, abandoned.

[51] Int. Cl.[3] ..... A63F 3/00

[52] U.S. Cl. ..... 273/239; 273/256; 273/254; 273/290

[58] Field of Search ..... 273/239, 249, 251, 252, 273/254, 256, 290, 288

[56] References Cited

U.S. PATENT DOCUMENTS

| | | | |
|---|---|---|---|
| 447,247 | 2/1891 | Jones | 273/254 |
| 1,631,505 | 6/1927 | Samis | 273/249 |
| 2,128,608 | 8/1938 | Goertemiller | 273/251 |
| 2,610,060 | 9/1952 | Powell | 273/290 |
| 2,977,713 | 4/1961 | Alelyunas | 273/249 |
| 3,104,106 | 9/1963 | Kenny | 273/249 |
| 3,722,885 | 3/1973 | Leaf | 273/1 R |
| 4,062,545 | 12/1977 | Witney | 273/239 |

FOREIGN PATENT DOCUMENTS

| | | | |
|---|---|---|---|
| 1045961 | 10/1966 | United Kingdom | 273/256 |
| 1482321 | 8/1977 | United Kingdom | 273/243 |

*Primary Examiner*—Richard C. Pinkham
*Assistant Examiner*—Carl Moy

[57] ABSTRACT

A travel game device is disclosed comprising a game board and a plurality of card sets, each card set having individual cards therein with instructions thereon for the advance of game play. The game also has game pieces for movement over a simulated map route and chance means such as one die or more for the advancement of the game piece and the selection of cards from the card sets for the advancement of game play.

4 Claims, 5 Drawing Figures

FIG. 1
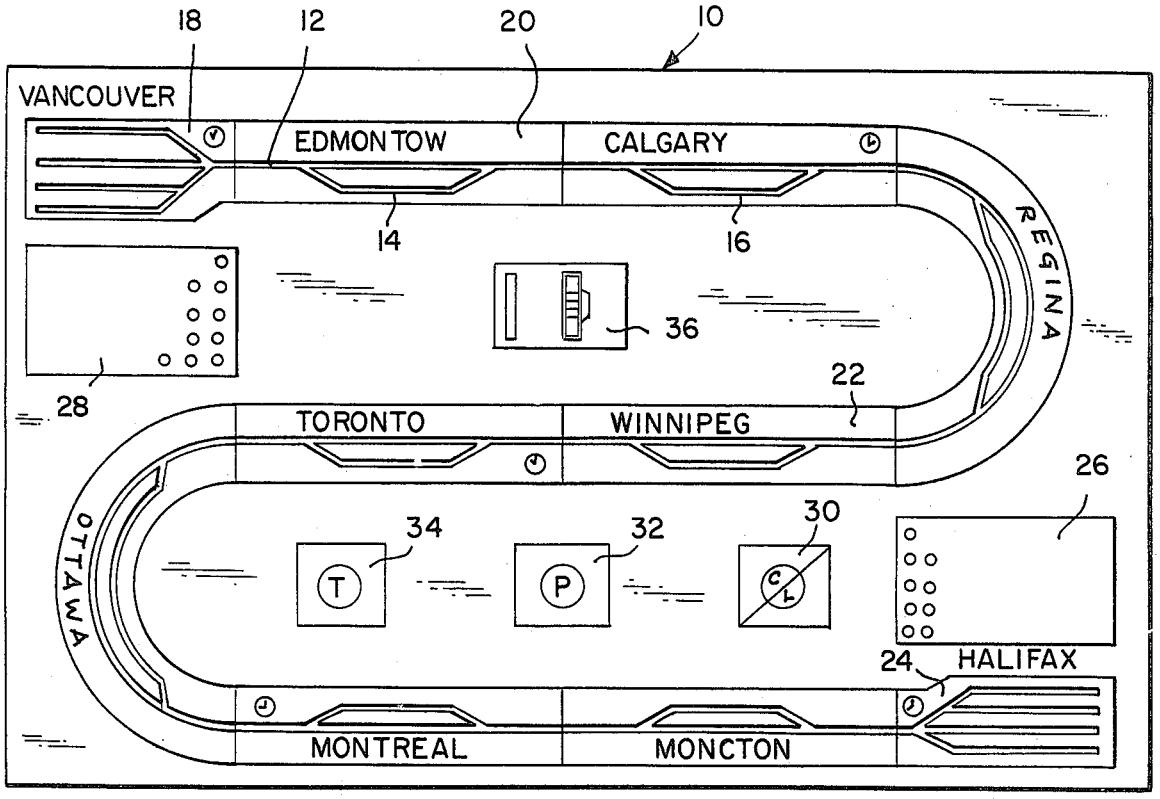
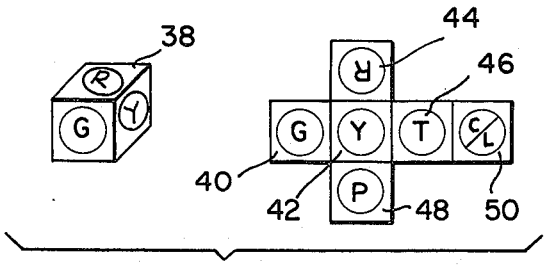
FIG. 2
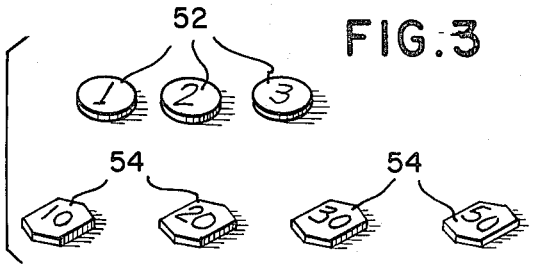
FIG. 3
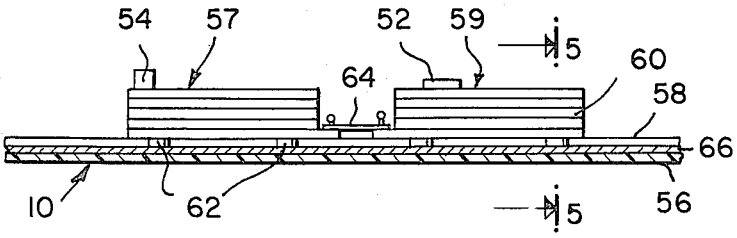
FIG. 4
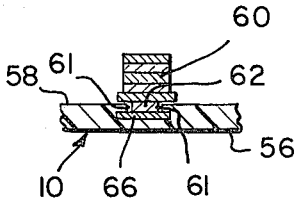
FIG. 5

TRAVEL GAME DEVICE

This application is a continuation in part of U.S. Patent Application Ser. No. 692,365 filed June 3, 1976, now abandoned.

SUMMARY OF THE INVENTION

The present invention relates to a game device comprising a game board having a simulated map route thereon with starting and terminal destinations also being marked thereon.

A first set of cards is provided, each card from said first set indicating at least one opportunity for revenue generation, railroad car and/or locomotive drops and car trading.

A second set of cards is provided, each card from said second set indicating at least one opportunity for train repairs without cost, advancement or game pieces and/or revenue generation.

A third set of cards is also provided, each card indicating at least one disadvantage of (a) road and/or equipment impediment to prevent the advance of game pieces or (b) the assessment of fees.

A fourth set of cards is provided, each card from said fourth set indicating commodity hauling rights comprising a license for the hauling of commodities listed thereon, said card designating the commodity carried and revenues to be gained from said commodity hauling rights.

Chance means are provided having the colors of railroad signal lights and indicia corresponding to said cards for the selection of one of said cards or said colors.

A game piece member is provided, the game piece being advanced by the selection of said colors, or one of the cards from the first, second or third set and optionally the fourth set to control the play of the game. A card in one variation may be selected from the fourth set when a game piece is advanced to a destination.

The chance device may comprise dice means, i.e. either a single die or a plurality of dice, each die having green, yellow and red colored sides and one side of each bearing indicia referring to said first set, second set and/or third set of cards. When one die is used with the aforesaid markings the card from the fourth set is selected when the game piece is advanced to a pre-set destination on the board. If a plurality of dice are used at least one may optionally contain indicia for selection of a card from the fourth card set. If the option is not employed with a plurality of dice, the card from the fourth card set is selected in the same manner where one die is used.

The map route may comprise simulated railroad tracks and the destinations may comprise stations wherein the distance between the stations is marked on the aforementioned game board.

The simulated railroad tracks may comprise a ferromagnetic groove and said game piece may comprise a ferromagnetic simulated railroad locomotive in combination with railroad cars.

Additionally, removable indicia may be secured on the game pieces to indicate train size and type, the indicia also being ferro-magnetic.

The expression "ferro-magnetic" as applied to the track, or game piece or indicia is intended to mean a magnetizable material or a magnetic material, it being the object and the intention to have the game piece magnetically attracted to the simulated railroad track, and the indicia, where employed, magnetically attracted to the game piece. By way of example, and not limitation, the railroad track in this instance, may comprise iron or an iron alloy strip placed along the groove on the game board and a magnetite piece would be employed to simulate the railroad locomotive and/or cars whereas the indicia would also be an iron or iron alloy. All three may also be a magnetic material such as magnetite so long as the various pieces designated as the ferro-magnetic pieces are magnetically attracted to one another.

BRIEF DESCRIPTION OF THE SEVERAL VIEWS OF THE DRAWING

FIG. 1 is a plan view of the game board having a simulated railroad route thereon and game playing pieces and cards according to one embodiment of the present invention.

FIG. 2 comprises a three dimensional view of a die having various colors and indicia thereon, a plan view also being included in FIG. 2 showing the various indicia on the six faces of the die according to an embodiment of the present invention.

FIG. 3 comprises markers to be attached to the game pieces according to an embodiment of the present invention.

FIG. 4 comprises a side elevation in section showing coupled game pieces in place on the game board in a groove therein according to an embodiment of the present invention.

FIG. 5 is a sectional view taken along the line 5—5 of FIG. 4.

DETAILED DESCRIPTION

Various transportation game devices are disclosed in the prior art U.S. Pat. No. 3,851,881 Smith; U.S. Pat. No. 3,638,946 Bain; U.S. Pat. No. 2,977,713 Alelyunas; U.S. Pat. No. 2,163,011 Schaub; and, U.S. Pat. No. 1,652,851 Bendtin.

The present invention relates to a novel game apparatus which will be understood in greater detail by reference to the disclosure and claims that follow as well as the appended drawing.

Referring to the appended drawing, a game board 10 is illustrated having a simulated map route 12 thereon, such as a simulated railroad track route with starting and terminal destinations 18 and 24, various railroad track 12. Intermediate destinations 20 and 22 are provided on the game board. Sidings 16 are also provided on the board.

A first set of cards 30 is provided, each card from the first set indicating at least one opportunity for revenue generation or railroad car and/or locomotive drops and/or card trading. A second set of cards 32 is also provided on the game board, each card from said second set indicating at least one opportunity for train repairs without cost, advance of the game piece or revenue generation.

A third set of cards 34 is provided, each card indicating at least one disadvantage of (a) road and equipment impediments to prevent advance of a game piece or (b) the assessment of fees.

A fourth set of cards 36 is also provided each card indicating a commodity hauling right comprising a license for hauling commodities listed thereon, each card from said fourth set designating the commodity carried and revenues to be gained from said commodity hauling rights.

A die 38 having the various indicia 40,42 and 44 comprising respectively a green side, yellow side and red side along with sides 46, 48 and 50 corresponding respectively to the cards 34,32 and 30 are also provided, either a single die 38 or a plurality of dice 38 especially a pair of dice 38 being employed to play the game of the present invention. When a plurality of dice are employed, at least one die may have markings for selection of a card from set 36, the markings in one instance comprising the letters "CHR."

Markers 52 comprising markers to designate the number of locomotive (i.e., 1, 2 or 3 locomotives in a train) are attachable to game pieces such as the game pieces 57 and 59 illustrated in FIG. 4. Train car markers 54 are attachable to one of the game pieces 57 and 59 not designated as a locomotive to designate the number of cars in the train. Simulated railroad rolling stock 57 and 59 are coupled to one another through a coupling 64. The cars 57 and 59 have magnets therein such as magnet 60 for the attachment of either the locomotive markers or indicia 52 or the train car markers or indicia 54. The simulated railroad cars 57 and 59 are also secured to the game board 10 by means of magnets 62 positioned along the bottom thereof to ride in a slot 61 formed in piece 58 on either side of metal strip 66 at the bottom of groove 61, the piece 58 being secured to a base piece 56.

The first set of cards 30 having the designation "C/L" comprise car and locomotive cards each card having various indicia thereon such as the following:

1. Haul 20 cars of wheat from Winnepeg to Toronto. Collect $2,160 on delivery in Toronto. If you do not own hauling rights, pay owner $1,000. Place and remove train markers accordingly.

2. Haul 20 cars piggyback vans Montreal to Winnepeg. Collect $4,000 on delivery to Winnepeg. If you do not own hauling rights, pay owner $2,500. Place and remove train markers accordingly.

3. Train dispatcher says "SET OFF 20 CARS AT NEXT STATION".

4. Your train has been involved in a highway accident causing damage. Set off one locomotive and 20 cars at next station ahead. Change markers accordingly.

5. Keep this card face down. You may pass it to an opponent at a meeting point requiring exchange of cards and train markers which is of most benefit to you.

The second set of cards 32 bearing an indicia "P" or proceed cards may each have by way of example one of the following notations:

1. Master repair card. Your trouble is repaired. It is not necessary to miss a turn if you have this card. Place back on bottom of pile when used.

2. If you are holding this card when two reds are rolled on the dice, train dispatcher authorizes you to proceed to next siding anyway. Place card on bottom of pile when used.

3. Collect $8,000 insurance payment due you.

4. Train dispatcher has authorized you to move to station ahead.

5. Collect bonus of $3,000 for fast delivery of piggyback vans containing merchandise to Vancouver.

6. Your train is authorized to move ahead two stations whenever you wish. Place card back on pile when used.

The third set of cards 34 have the indicia "T" thereon and are designated trouble cards. Examples of the various instructions on the trouble cards are as follows:

1. Bridge ahead is washed out. Miss one turn unless you have master repair card.

2. Pay $1,500 demurrage charges assessed. (Place card back on bottom of pile).

3. All your locomotives have stopped because of electrical trouble. Miss one turn unless you have locomotive repair card.

4. Track ahead requires repairs. Pay $2,500 and miss one turn unless you have master repair card.

5. Pay $6,000 as your portion of monthly insurance cost.

6. Signal trouble ahead. Miss one turn unless you have master repair card.

7. Wrecking cranes working ahead. Miss one turn.

The fourth set of cards 36 or commodity hauling rights cards by way of example have the licenses for hauling various commodities listed thereon including the freight classification, the minimum carload weight, the purchase price and sales price of the commodity haul right card, the type of car such as a box car or flat car or hopper car, usually used for the hauling of the cargo and the point-to-point revenue to be charged based on the volume as well as the distance covered. The following are commodity hauling right cards employed in one embodiment of the game device of this invention.

POTATOES
Freight Classification 30
Minimum Car Load Weight-40,000 lbs.
Purchase Price $9000-Sale Price $4,500

| Cars | From-To | Rate | Amount |
|---|---|---|---|
| 60 | Moncton-Ottawa | .50 | $12,000 |
| 40 | Moncton-Halifax | .40 | $6,400 |
| 30 | Moncton-Calgary | .60 | $7,200 |

MEATS
Freight Classification 55
Minimum Car Load Weight 20,000 lbs.
Purchase Price $6000 Sale Price $3000

| Cars | From-To | Rate | Amount |
|---|---|---|---|
| 50 | Calgary-Vancouver | .90 | $9000 |
| 30 | Calgary-Toronto | 1.00 | $6000 |
| 20 | Calgary-Moncton | 1.40 | $4400 |

WHEAT
Freight Classification 30
Minimum Car Load Weight-36000 lbs.
Purchase Price $6500 Sale Price $3500

| Cars | From-To | Rate | Amount |
|---|---|---|---|
| 60 | Winnipeg-Montreal | .40 | $8640 |
| 40 | Winnipeg-Vancouver | .50 | $7000 |
| 30 | Winnipeg-Toronto | .35 | $3780 |

FUEL
Freight Classification 45
Minimum Car Load Weight 30,000 lbs.
Purchase Price $7,500 Sale Price $3500

| Cars | From-To | Rate | Amount |
|---|---|---|---|
| 60 | Edmonton-Vancouver | .80 | $14,400 |
| 40 | Edmonton-Winnipeg | .70 | $8,400 |
| 20 | Edmonton-Montreal | .90 | $5,400 |

PIGGY BACK VANS
Freight Classification 80
Minimum Car Load Weight 35,000 lbs.
Purchase Price $8500 Sale Price 4500

| Cars | From-To | Rate | Amount |
|---|---|---|---|
| 50 | Montreal-Winnipeg | .70 | $12,250 |
| 40 | Montreal-Edmonton | .80 | $11,200 |
| 20 | Montreal-Halifax | .60 | $4,200 |

-continued

LUMBER
Freight Classification 45
Minimum Car Load Weight 36000 lbs.
Purchase Price $7500 Sale Price $3500

| Cars | From-To | Rate | Amount |
|---|---|---|---|
| 50 | Vancouver-Regina | .50 | $12,000 |
| 40 | Vancouver-Ottawa | .75 | $10,800 |
| 30 | Vancouver-Calgary | .45 | $4,860 |

CONTAINERS
Freight Classification 75
Minimum Car Load Weight 20,000 lbs.
Purchase Price $8000 Sale Price $4000

| Cars | From-To | Rate | Amount |
|---|---|---|---|
| 50 | Halifax-Winnipeg | 1.10 | $11,000 |
| 40 | Halifax-Toronto | .90 | $7,200 |
| 30 | Halifax-Moncton | .60 | $3,200 |

PAPER
Freight Classification 60
Minimum Car Load Weight 30,000 lbs.
Purchase Price $10,000, Sale Price $5000

| Cars | From-To | Rate | Amount |
|---|---|---|---|
| 40 | Ottawa-Calgary | 1.00 | $12,000 |
| 30 | Ottawa-Regina | .90 | $8,100 |
| 20 | Ottawa-Halifax | .70 | $4,200 |

POTASH
Freight Classification 45
Minimum Car Load Weight 40,000 lbs.
Purchase Price $6000 Sale Price $3000

| Cars | From-To | Rate | Amount |
|---|---|---|---|
| 40 | Regina-Montreal | .60 | $9600 |
| 30 | Regina-Edmonton | .50 | $6000 |
| 20 | Regina-Ottawa | .55 | $4400 |

AUTOMOBILES
Freight Classification 100
Minimum Car Load Weight 20,000 lbs.
Purchase Price $7000 Sale Price $3500

| Cars | From-To | Rate | Amount |
|---|---|---|---|
| 50 | Toronto-Edmonton | $1.25 | $12,500 |
| 30 | Toronto-Regina | $1.10 | $6,600 |
| 20 | Toronto-Moncton | $1.00 | $4,000 |

The "rate" referred to on the above commodity hauling rights is the rate per cwt. (i.e. hundred weight). The "amount" to be collected by the player holding these cards and hauling freight between the destinations marked on the cards is determined by multiplying the number of cars by the carload weight by the rate per cwt. For example, 60 carloads of potatoes×40,000 lbs.×0.50 per cwt. equals $12,000 revenue to be obtained by the player when this freight is hauled between Moncton and Ottawa.

In the embodiment of the game where the commodity hauling rights are purchased when the player arrives at a pre-designated destination, the above cards are made available for purchase to a player who moves his "train" or game piece to the station designated in the column headed "From" on such cards. For example, commodity hauling rights can be purchased for potatoes by a player who lands at Moncton, and similarly for the purchase of hauling rights for meat at Calgary, Wheat at Winnipeg and so forth. In the embodiment where the commodity hauling right cards are selected by the chance means referred to herein, each time a selection of commodity hauling rights is indicated by the chance means, these cards are arranged in a stack and one of such cards may be taken from the top of such stack.

The game is played by the distribution of funds at the beginning followed by the purchase of locomotives, each player having the option to retain sufficient discretionary funds to pay for hauling rights, repairs and the like as noted on the various cards from the four sets previously described. The cash spent at the beginning of the game is a business judgment and is apportioned to anticipate the train needs such as the purchase of locomotives and the future purchase of commodity hauling rights and penalties assessed during the game. A locomotive, according to the rules can pull no more than a limited number of cars and if greater car lengths are required, additional locomotives have to be purchased. By way of example, if one locomotive may be used to haul 40 cars (marker 52 with the number "one" thereon), a two locomotive marker (marker 52 with the number "2" thereon) is placed on the game piece 57 and the car markers indicating 80 cars (game pieces 54 with the numbers "30" and "50" thereon), are placed on the game piece 59 to thereby indicate both the number of locomotives and cars in the train. These pieces will be added or removed during the course of play according to the various cards turned up from the first, second and third set of cards previously described. The game is best played with a plurality of players starting at opposite points on the game board, i.e. at points 18 and 24, the Vancouver and Halifax stations respectively, so that the players will meet at some point along the track 12 and will have to arrange various switching positions on the sidings, such as sidings 14 and 16. The game is played by rolling the single die or plurality of dice such as a pair of dice 38 to advance the game pieces until either one player obtains all of the money of the other players or has the greatest amount of money at the end of a set period of play.

In advancing the game piece by rolling a die or dice, the player rolling a green or yellow side on the die 38 is allowed to advance to the next station, whereas, if red comes up, the player has lost his turn.

When two dice are employed, any combination of green or yellow allows the player to advance to the next station. If a pair of red sides are turned up, the player loses his turn. Any side having the indicia "P", "T" or "C/L" allows the player to take one card off the top of the card sets having similar indicia thereon.

When a plurality of dice are used such as three, four, five or more dice one possible combination would be two red sides coming up with any combination of yellow or green. In the event the two red sides came up they are always controlling no matter what combination of yellow or green are obtained with the two red sides, and the player loses his turn.

If any of the indicia "P", "T" or "C/L" appear more than once when a plurality of dice are employed, only one card corresponding to such indicia may be taken from the pile and the player rolling the dice has the choice of which card is to be taken.

When a plurality of dice are used, the indicia "CHR" may be employed on at least one side of at least one of the die, and where any combination of "P" "T"; "C/L" or "CHR" appear only one card corresponding to such indicia may be selected at the option of the player rolling such combination.

As stated previously, the card from the fourth card set may be obtained by a player when he arrives at a pre-selected destination. By way of example and not of limitation arrival at the Halifax, Montreal, Toronto, Calgary and Vancouver stations may allow a player to obtain the commodity hauling right card. Obtaining the commodity hauling right card in this manner may also be combined with the previous manner of obtaining such commodity hauling right card, i.e., by employing a chance means to allow a player to obtain such card and specifically a die having at least one side bearing the indicia "CHR".

In a specific example of game play, four players are given $50,000 in denominations of $10,000 bills, $100 bills, $50 bills, $20 bills and $10 bills with $350,000 in the bank. The purchase price of locomotives is $5000 each. The cost of purchasing the commodity hauling right card is marked thereon. Cars are not purchased but are picked up when commodity hauling rights are obtained. The number of cars that can be hauled on each train is governed by the number of locomotives purchased specifically: 1 locomotive can haul 80 cars; 2 locomotives can haul 100 cars and 3 locomotives can haul 120 cars.

Game play can then start in the following manner:

(1) Toss a coin to determine the order of players in rolling the dice. Two players roll two dice 38 alternately from each end of the game board and each must roll and proceed to the next station indication to move their train.

(2) On arrival at each station, each player has the option of purchasing the commodity hauling rights card for that particular station. The last player leaving Halifax or Vancouver has the option of purchasing the commodity hauling rights before rolling the dice.

(3) Players have the option of using either track at each station when not occupied by another train, but must be in the side track in order to pick up cars and the main track at the station to drop off commodities.

(4) At the time commodity hauling rights are purchased, a player can then pick up cars (placing a car marker on train) which are to be moved in the direction the train is moving. Direction is indicated on hauling rights cards, and may be indicated on car markers and the game board. Magnetic car markers can only be placed on the train in one position.

(5) Players may only purchase and hold a maximum of two commodity hauling rights cards each, at any one time. Purchase of these cards is for the duration of the game unless sold or exchanged.

(6) Players successfully hauling the cars to a destination indicated on commodity hauling rights cards will collect the amount shown on the cards.

(7) As players move their trains from station to station there may be instances where they may pick up cars other than those for which they own the haulage rights, either by choice or by "C/L" cards. If they are successful in transporting the commodity to the destination and do not own the hauling rights, one half of the amount collected must be paid to the owner of the card.

(8) Repair and authorization cards may be kept until required and when used must be placed back on the bottom of the appropriate pile.

(9) Loss of a locomotive may occur through "C/L" cards. A player may not purchase a replacement until arrival at Halifax or Vancouver unless their train has only one locomotive. The purchase price is then ½ the original price.

The Player rolling a green or yellow side on the die 38 is allowed to advance to the next station, whereas, if red comes up, the Player has lost his turn. When a plurality of dice are employed, any combination of green or yellow allows the Player to advance to the next station. If a pair of red sides are turned up, the Player loses his turn. Any side having the indicia "P", "T" or "C/L" allows the Player to take one card off the top of the card sets having similar indicia thereon. If any of the aforementioned indicia appear more than once when a plurality of dice are employed, only one card corresponding to such indicia may be taken from the pile. When a plurality of dice are used, the indicia "CHR" may be employed on at least one side of at least one of the die. Optionally, as stated previously, the card from the fourth card set may be obtained by a Player when he arrives at a pre-selected destination. By way of example and not of limitation arrival at the Halifax, Montreal, Toronto, Calgary and Vancouver stations may allow a player to obtain the commodity hauling right card. Obtaining the commodity hauling right card in this manner may also be combined with the previous manner of obtaining such commodity hauling right card, i.e. by employing a chance means to allow a Player to obtain such card and specifically a die having at least one side bearing the indicia "CHR."

When a plurality of dice are used such as four dice one possible combination would be two red sides coming up with any combination of yellow or green. In this event the two red sides are controlling and the player loses his turn. "Any combination of yellow or green" as used herein shall mean all g-y, g-g or y-y combinations where two dice are employed, all g-g-y, g-g-g, g-y-y or y-y-y combinations for three dice and similarly for four, five, six or more where "y" represents yellow and "g" represents green.

Although the invention has been described by reference to some embodiments, it is not intended that the novel game device be limited thereby, but that modifications thereof are intended to be included as falling within the broad scope and spirit of the foregoing disclosure, the following claims and the appended drawings.

What is claimed is:

1. A game device comprising a game board having simulated map route means with starting and terminal destinations, intermediate destinations between said starting and terminal destinations marked thereon:

(1) a first set of cards, each card in said first set indicating at least one opportunity for:
  (a) revenue generation,
  (b) railroad car and/or locomotive drops,
  (c) card trading, (2) a second set of cards, each card of said second set indicating at least one opportunity for:
  (a) train repairs without cost,
  (b) advancing game pieces,
  (c) revenue generation, (3) a third set of cards, each card of said third set indicating at least one disadvantage of:
  (a) road and equipment impediments to prevent the advance of a game piece,
  (b) the assessment of fees, (4) a fourth set of cards, each card of said fourth set indicating commodity hauling rights comprising a license for hauling commodities listed thereon, and the revenues to be gained from said commodity hauling rights;

(5) chance means having railroad signal light colors and indicia corresponding to said card sets for the selection of a card from said set or said railroad signal light color comprising dice means having green, yellow and red colored sides and one side each bearing indicia referring to said first set, second set and third set of cards;

(6) game piece means, the movement of said game piece being controlled by the selection of said railroad signals or one card from said sets of cards by said chance means, said chance means also operative to select one of said cards to control the play of said game.

2. The game device of claim 1 where said map route comprises a ferro-magnetic groove simulating railroad tracks and said game piece comprises a ferro-magnetic simulated railroad locomotive in combination with railroad cars, said groove and said piece being magnetically attracted to each other.

3. The game device of claim 2 further comprising means having movable indicia securable to said game pieces to indicate train size and type.

4. The game device of claim 3 where said indicia are ferro-magnetic.

* * * * *